United States Patent [19]

Raspanti

[11] 4,328,069

[45] May 4, 1982

[54] PROCESS FOR THE ELIMINATION OF THE RESIDUAL FLUORESCENCE RESULTING FROM OPTICAL BLEACHING AGENTS

[75] Inventor: Giuseppe Raspanti, Mozzo, Italy

[73] Assignee: Apital Produzioni Industriall S.p.A., Milan, Italy

[21] Appl. No.: 145,489

[22] Filed: May 1, 1980

[30] Foreign Application Priority Data

Dec. 21, 1979 [IT] Italy ..... 28326 A/79

[51] Int. Cl.[3] ..... D21H 3/58

[52] U.S. Cl. ..... 162/162; 162/164.6; 525/420; 525/435; 528/327; 528/331; 528/423; 427/170

[58] Field of Search ..... 162/162, 164 R, 164.6; 528/331, 423, 327; 525/420, 435; 427/170

[56] References Cited

U.S. PATENT DOCUMENTS 3,639,642 2/1972 Matter et al. ..... 162/162

4,098,454 7/1978 Raspanti et al. ..... 162/162

*Primary Examiner*—William F. Smith

*Attorney, Agent, or Firm*—Bucknam and Archer

[57] ABSTRACT

A process for the elimination of the fluorescence effect resulting from the treatment of fibrous materials with optical anionic agents is described which consists of treating the fibrous materials with a water soluble salt of a polymer containing the imidazoline ring of formula I

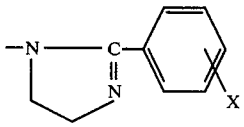

(I)

wherein X is in the position meta or para with respect to the imidazoline ring and X is

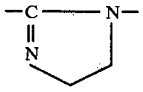

or —CO—NH—

The imidazoline-containing compounds prepared by reacting diethylenetriamine or triethylenetetramine with terephthalic or isophthalic acid followed by cyclization are reacted with dicyandiamide. The water soluble salt is an acid addition salt or a quaternary ammonium salt. The new polymers are described.

6 Claims, No Drawings

PROCESS FOR THE ELIMINATION OF THE RESIDUAL FLUORESCENCE RESULTING FROM OPTICAL BLEACHING AGENTS

This invention relates to fibrous materials and more specifically to fibrous materials which have been bleached and to a process for the removal of the fluorescence resulting from the use of optical bleaching agents. More specifically, the invention relates to paper.

It has now been found, surprisingly, that fibrous materials and particularly paper may be treated according to this invention with polymeric substances, the latter being used in the form of soluble salts in water. The polymers are obtained by reaction of dicyandiamide with monomers containing the imidazoline ring of formula I hereinbelow;

(I)

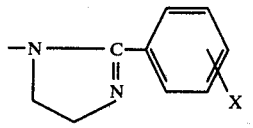

in which X may be in the para or meta position with respect to the imidazoline ring and X may be one of the groups shown hereinbelow;

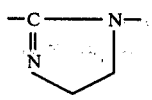

or —CO—NH— which groups may be connected by a carbon chain as will be discussed in more detail hereinbelow.

It is well known that the fluorescence resulting from the use of optical bleaching agents on fibrous materials is not always desirable and in particular, this fluorescence may result, totally casually and most undesirably, because a material which has already been subjected to the process of optical bleaching is recycled. Another reason for the fluorescence may be due to contamination of the apparatus from a prior operation. In all these cases, it is useful and convenient to dispose of the material for the purpose of eliminating fluorescence.

The removal of the fluorescence effect resulting from the use of optical bleaching agents is of great practical utility, particularly in paper factories. In these factories, the production of unbleached paper after one production cycle in which bleached paper is obtained, requires the perfect cleaning of the apparatus and of the entire recycle system for the purpose of removing completely the residues of the optical bleaching agents. These cleaning operations require obviously time and a great quantity of water, and consequently are very expensive; further, they cause a substantial decrease of the production capacity.

One possible solution which has been considered rational and economical has been to give up the elimination of the residual optical bleaching agents and instead to add to the cellulose which is used to produce unbleached paper, materials which are capable of destroying the effect of the optical bleaching agents. This addition may be carried out before or after the formation of a sheet of paper.

The crux of the present invention resides in the finding that very satisfactory results are achieved by means of the polymers described hereinabove. The process according to the present invention permits to achieve the elimination of the fluorescence effect and permits to produce unbleached paper using recycled bleached paper.

The substances obtained by reaction of dicyandiamide with monomers containing the imidazoline ring of formula I destroy the fluorescence action of the optical bleaching agents containing anionic groups, for instance sulfonic groups. According to one embodiment of the invention, these optical bleaching agents are derivatives of stilbene.

The fibrous materials to which the process of the present invention is applicable are, for instance cellulose textile fibers or regenerated cellulose, but above all, paper.

In the operations used in paper factories, the polymers according to this invention, in the form of water soluble salts, may be used either in mass or in size-press form. The chemical composition of the substances to be used in accordance with the process of this invention has already been discussed hereinabove. More specifically, these products are polymers obtained by reaction of dicyandiamide with monomers containing the imidazoline ring of formula I. Further, the polymers are used in the form of addition salts with acids or quaternary ammonium salts. These monomers mainly have the formulae II, III, IV and V shown hereinbelow:

(II)

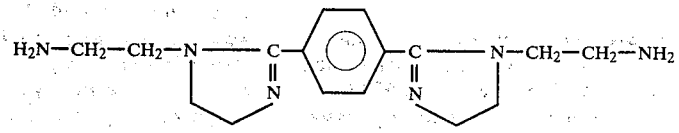

(III)

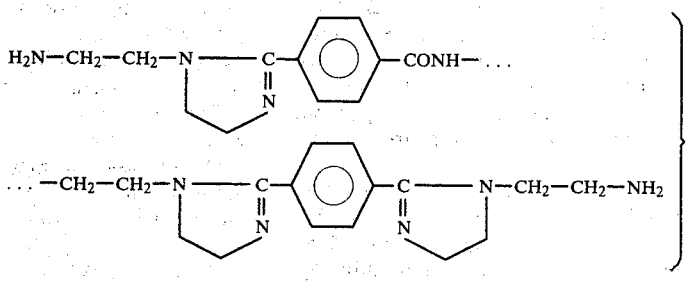

-continued

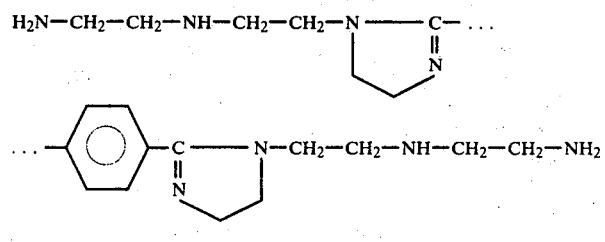

(IV)

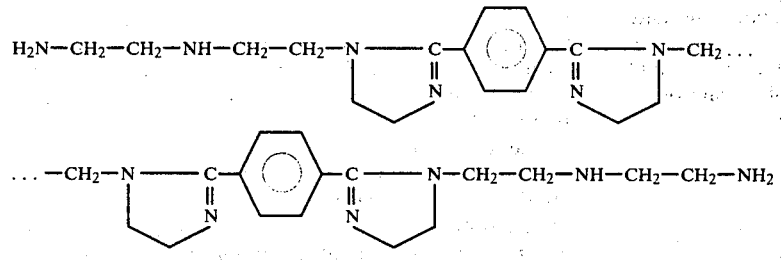

(V)

The chemical composition of the polymers which are obtained according to the reaction between the dicyandiamide and the monomers of Formulae II–V, is not easily definable by analysis nor is it readily identifiable. For instance, by reaction of dicyandiamide with monomer III, there is former a polymer which contains recurring units which may be represented by the following schematic formulation VI

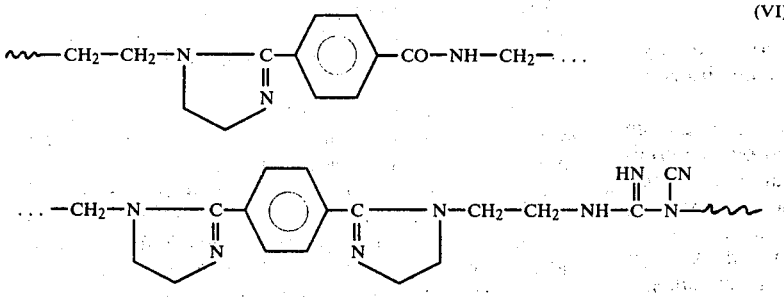

(VI)

In any event, it should be clear that the present invention is not limited to any exact chemical constitution of the polymeric substances being used. The results being achieved with the compounds according to the present invention depend on the reagents being used as well as the procedure used for the production of the same compounds.

Several processes are known in the art for the removal of the fluorescence resulting from optical bleaching agents. For instance, in U.S. Pat. No. 3,639,642, a process is described which utilizes products of polycondensation of cyclic amines; similarly, U.S. Pat. No. 4,098,954 describes a method for the removal of the fluorescence effect resulting from the same residual bleaching agents. However, the efficiency of the processes described in the two above mentioned citations is substantially inferior to the process according to the present invention. This will be shown in the example hereinbelow.

The monomers which are used as starting materials of Formulae II–V, may be synthesized by means of known methods. For instance, they may be synthesized by reaction at 100°–160° C. between 1 mole of terephthalic acid or isophthalic acid or their functional derivatives, such as the acid chlorides or esters with at least $1\frac{1}{2}$ mole of diethylenetriamine or triethylenetetramine, followed by cyclization of the intermediate amides at 160°–230° C., a reaction which yields the corresponding imidazolines. The preparation of the monomers II–V depends on specific reagents as well as the molecular ratios between the same reagents.

Monomers II–V which are prepared as described are then subjected to condensation with dicyandiamide. In general, one mole of monomer is polycondensed with 0.2–2.0 moles, preferably 0.6–1.4 moles of dicyandiamide. The products are polymers containing the imidazoline ring of formula I. The polymers thus obtained are subsequently converted into salts, preferably with strong mineral acids or are converted into quaternary compounds with alkylating agents. The reaction of polycondensation of monomers of formulae II–V and dicyandiamide is preferably carried out in solvents of sufficiently high boiling points, preferably ethyleneglycol, diethyleneglycol, propyleneglycol or their respective ethers. Particularly advantageous are ethyleneglycol and propyleneglycol.

For the purpose of preparation of the salts of the polymers obtained according to this invention, there are preferably used hydrochloric acid, hydrobromic acid, sulfuric acid, phosphoric acid, toluenesulfuric acid, acetic acid, formic acid and particularly hydrochloric acid.

For the preparation of the quaternary salts of polymers in accordance with the present invention, there may be used dimethyl sulfate, diethyl sulfate, methyl chloride, benzyl chloride, methyl benzene sulfonate or methyl toluene sulfonate. Particularly advantageous are dimethyl sulfate, diethyl sulfate and benzyl chloride. The examples which follow illustrate the preparation of the compounds according to the present invention.

EXAMPLE 1

100 parts of diethylenetriamine and 194 parts of dimethylterephthalate are heated in a nitrogen atmosphere, for three hours at 195°-200° C. During this period of time, there is collected about 80 parts of distillate which consists preferably of methanol. The apparatus is then evacuated, removing nitrogen. The vacuum is then slowly increased in the course of about 7 hours up to 15-20 Torr, so that the temperature of the reaction mixture remains always between 185° and 200° C. During this period, there are collected 900 parts of a second distillate which consists of excess of diethylenetriamine and the water of reaction.

The connection with the vacuum pump is then interrupted and nitrogen is passed through the apparatus. There is then added 150 parts of ethyleneglycol at a temperature of 200°-180° C. To the solution which is thus obtained, cooled to 150° C., there is then added 33.6 parts of dicyandiamide. The mixture is heated to 200°-210° C. while stirring for 4 hours at the same temperature, in a nitrogen atmosphere.

The ammonia which is given off is eliminated by leading it into a solution of hydrochloric acid. After cooling the reaction mixture to 90° C., there is added 150 parts of concentrated hydrochloric acid while keeping the temperature between 90° and 100° C. The mixture is then diluted with 150 parts of water. The pH is adjusted, if necessary, to a value of 5-6. The mixture is then cooled to room temperature and is then removed from the container so that an aqueous solution of a polymer containing the imidazoline group of formula I, in the form of the hydrochloride salts, is obtained.

EXAMPLE 2

The reaction is carried out in the same manner as Example 1 up to the reaction with dicyandiamide. After stirring four hours at 200°-210° C., the reaction mixture is cooled to 120°-130° C. and slowly at this temperature there is added 177 parts of benzyl chloride. The mixture is stirred for two hours at 120°-130° C., cooled at 100° C. and slowly 560 parts of water are added; the mixture is cooled to room temperature and is then removed from the vessel obtaining an aqueous solution of a polymer containing the imidazole group of formula I in the form of a quaternary ammonium salt.

EXAMPLE OF APPLICATION

In this example, the effects of removal of fluorescence are illustrated. Specifically, the product of Example 1, according to the present invention, called Product A is compared with Example A of U.S. Pat. No. 3,639,642, which is called Product B, and with the product according to Example 2 of U.S. Pat. No. 4,098,954 which is referred to as Product C.

A 3% suspension of cellulose consisting of 50% of spruce cellulose sulfite and 50% of beech cellulose sulfite, is bleached by the addition of the bleaching agent of formula VII hereinbelow, in the amount of 0.15% with respect to the cellulose.

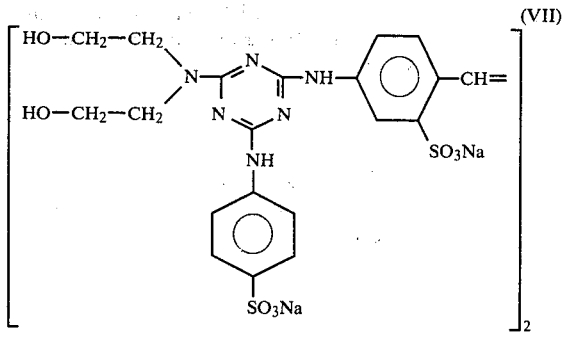

Samples of 100 ml each of the cellulose paste previously prepared are used. To each sample, there is added 6 ml of 1% Bewoid glue and after five minutes of agitation, 6 ml of 1% solution of aluminum sulfate.

After five minutes of stirring, each one of the samples is treated with increasing amounts of Product A, Product B and Product C. The material is again stirred for five minutes. Then the suspensions are introduced into the column "forma foglio" of the apparatus Rapid-Koethen, diluted with 3.5 liters of water to which 19 ml of 20% aluminum sulfate solution had been previously added. The material is filtered and the wet disk is dried for ten minutes at 90° C.

A sample of material to which no additive for the removal of the fluorescence effects has been added is treated in the same manner as a control. In this case, the disk represents the reference point of the bleaching effect. Then, the degree of bleaching Elrepho of the disks with the filter Tappi R 457 Xenon lamp is determined with and without an ultraviolet filter. In this manner, the residual fluorescence of the disk is calculated on the basis of the difference of the values obtained with and without the ultraviolet filter.

The calculations are made by giving the value of 100 to the difference Δ for the degree of bleaching of the dish with and without the ultraviolet filter relative to the control. In this manner, the percentage of the residual fluorescence in the disks obtained by addition of Products A, B and C is determined.

The Δ B% expresses the residual fluorescence with reference to the degree of bleaching of the disk, taking as the value 100. The following table summarizes the results achieved.

TABLE

| | | PRODUCT A (%) | | | | PRODUCT B (%) | | | | PRODUCT C (%) | | | |
|---|---|---|---|---|---|---|---|---|---|---|---|---|---|
| | 0 | 0.05 | 0.25 | 0.5 | 0.75 | 0.05 | 0.25 | 0.5 | 0.75 | 0.05 | 0.25 | 0.5 | 0.75 |
| FLUORESCENCE % | 100 | 56 | 9.6 | 0 | — | 81 | 36 | 13.2 | 5 | 75.2 | 20.8 | 5.2 | 1.2 |
| Δ B % | 13.9 | 7.78 | 1.33 | 0 | — | 11.2 | 5.0 | 1.8 | 0.7 | 10.45 | 2.9 | 0.71 | 0.16 |

*The percentages of Products A, B and C represent the amount of active substances The results in the foregoing table show that Product A is more effective than Products B and C, even with very low percentage values, that is in the range of 0.05%-0.25%. Further, even with a value of 0.5% of a compound according to the invention, one achieves a total removal of fluorescence, but the total removal of fluorescence cannot be achieved even with double the percentage of Products B and C.

What is claimed is:

1. The process for the elimination of the fluorescence effect resulting from the treatment of fibrous materials with optical anionic agents which consists of treating said fibrous materials with a water soluble salt or a quaternary salt in an amount sufficient to nullify said fluorescence effect of a polymer containing the imidazoline ring of Formula (I)

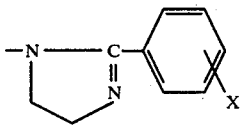

(I)

wherein X is in position meta or para with respect to the imidazoline ring and X is

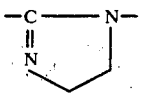

or —CO—NH— said polymer being prepared by reacting at least 1.5 moles of diethylenetriamine or triethylenetetramine with 1 mole of terephthalic or isophthalic acid or one of their functional derivatives, whereby an amide is obtained, cyclizing said amide to obtain a monomer containing said imidazoline ring, reacting said monomer with dicyandiamide to obtain a polymer followed by salt formation with a strong acid or quaternization with an alkylating agent.

2. The process according to claim 1 wherein the monomer has the formula II, III, IV or V hereinbelow:

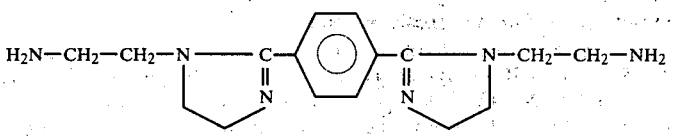

(II)

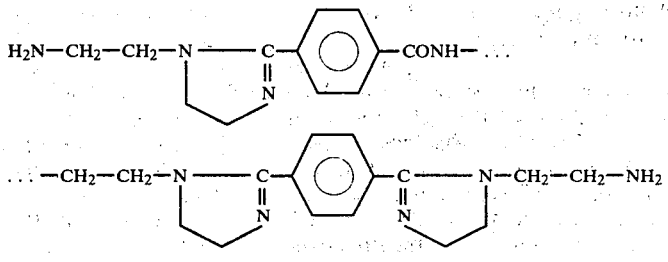

(III)

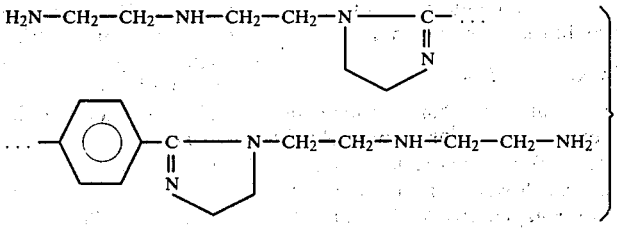

(IV)

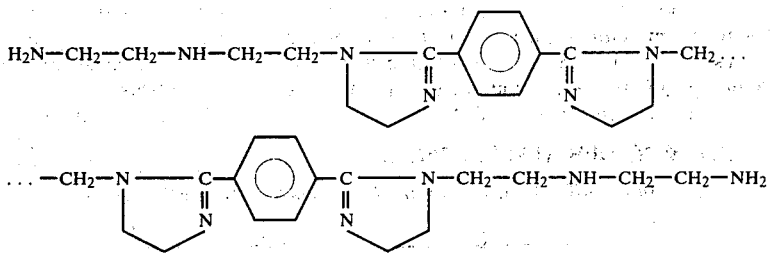

(V)

3. The process according to claim 1 wherein salt formation is carried out with hydrochloric acid.

4. The process according to claim 1 wherein quaternization is carried out with dimethyl sulfate.

5. The process according to claim 1 wherein quaternization of the polymer is carried out with benzyl chloride.

6. The process according to claim 1 wherein the amount of said polymer is at least 0.05% based on the amount of said fibrous materials.

* * * * *